US012123169B2

(12) United States Patent
Hirasawa et al.

(10) Patent No.: US 12,123,169 B2
(45) Date of Patent: Oct. 22, 2024

(54) CONSTRUCTION MACHINE

(71) Applicant: Hitachi Construction Machinery Co., Ltd., Tokyo (JP)

(72) Inventors: Shigeru Hirasawa, Mito (JP); Tsuyoshi Kakegawa, Ibaraki (JP); Wataru Isaka, Mito (JP); Takeo Manabe, Ishioka (JP); Hiroyuki Isobe, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 46 days.

(21) Appl. No.: 17/789,462

(22) PCT Filed: Jan. 22, 2021

(86) PCT No.: PCT/JP2021/002316
§ 371 (c)(1),
(2) Date: Jun. 27, 2022

(87) PCT Pub. No.: WO2021/171853
PCT Pub. Date: Sep. 2, 2021

(65) Prior Publication Data

US 2023/0038839 A1 Feb. 9, 2023

(30) Foreign Application Priority Data

Feb. 27, 2020 (JP) ..... 2020-031500

(51) Int. Cl.
*E02F 9/20* (2006.01)
*E02F 9/24* (2006.01)

(52) U.S. Cl.
CPC ..... *E02F 9/2004* (2013.01); *E02F 9/24* (2013.01)

(58) Field of Classification Search
None
See application file for complete search history.

(56) References Cited

U.S. PATENT DOCUMENTS 10,329,736 B2 * 6/2019 Nomura ..... G05G 1/06

FOREIGN PATENT DOCUMENTS

JP 9-25650 A 1/1997
JP 2001-40707 A 2/2001
(Continued)

OTHER PUBLICATIONS

International Search Report (PCT/ISA/210) issued in PCT Application No. PCT/JP2021/002316 dated Apr. 6, 2021 with English translation (four (4) pages).
(Continued)

*Primary Examiner* — Vicky A Johnson
(74) *Attorney, Agent, or Firm* — Crowell & Moring LLP

(57) ABSTRACT

A left console device (11) disposed on an entrance (8A)-side of a cab (8) is provided with a gate lock device (19). The gate lock device (19) includes a gate lock lever (20) which has an operating part (20C) to be operated by an operator and is rotationally displaced between a lock position and an unlock position, and a spring member (22) which urges the gate lock lever (20) toward the lock position or the unlock position. The spring member (22) is configured to urge the gate lock lever (20) toward the unlock position when the operating part (20C) of the gate lock lever (20) is in a height position lower than an upper surface (16C) of the left console device (11) (an upper cover (16)) and urges the gate lock lever (20) toward the lock position when the operating part (20C) of the gate lock lever (20) is in a height position higher than the upper surface (16C) of the left console device (11).

3 Claims, 8 Drawing Sheets

(56) References Cited

FOREIGN PATENT DOCUMENTS

| | | | | | |
|---|---|---|---|---|---|
| JP | 2002070079 | A | * | 3/2002 | ..... E02F 9/2004 |
| JP | 2008-63889 | A | | 3/2008 | |
| JP | 2015-117520 | A | | 6/2015 | |
| JP | 2019-27099 | A | | 2/2019 | |
| JP | 2019157433 | A | * | 9/2019 | |

OTHER PUBLICATIONS

Japanese-language Written Opinion (PCT/ISA/237) issued in PCT Application No. PCT/JP2021/002316 dated Apr. 6, 2021 (four (4) pages).

* cited by examiner

CONSTRUCTION MACHINE

TECHNICAL FIELD

The present invention relates to construction machines, such as a hydraulic excavator provided with a gate lock device.

BACKGROUND ART

In general, a hydraulic excavator representative of a construction machine is provided with an automotive lower traveling structure, an upper revolving structure mounted on the lower traveling structure to be capable of revolving thereto and a working mechanism disposed on the front side of the upper revolving structure to be capable of lifting and tilting thereto. The hydraulic excavator carries out an excavating work of earth and sand or the like using the working mechanism while revolving the upper revolving structure.

A cab defining an operator's room therein is disposed in a front left side of the upper revolving structure. An operator's seat is disposed in the cab, and an operator sits on and goes out from the operator's seat through an entrance formed on a left side surface of the cab. Console devices provided with operating levers are arranged on both sides of the operator's seat in the left-right direction to control the revolving movement of the upper revolving structure and the movement of the working mechanism.

A gate lock device is disposed on the left console device, which is positioned on the entrance side, of the left and right console devices. The gate lock device is provided with a gate lock lever having an operating part which is operated by the operator, and the gate lock lever rotationally displaces between a lock position in which the operation by the operating lever is made invalid and an unlock position in which the operation by the operating lever is made valid (Patent Document 1).

PRIOR ART DOCUMENT

Patent Document

Patent Document 1: Japanese Patent Laid-Open No. 2008-063889

SUMMARY OF THE INVENTION

The gate lock lever according to the conventional technology is attached on a support member through a shaft, and on a basis of the shaft as a rotation fulcrum, rotationally displaces between the lock position and the unlock position. A spring member is disposed to urge the gate lock lever to the lock position or the unlock position. When the gate lock lever is rotationally displaced to the lock position, the gate lock lever is retained in the lock position by the spring member. On the other hand, when the gate lock lever is rotationally displaced to the unlock position, the gate lock lever is retained in the unlock position by the spring member.

In this conventional technology, a switching position of the gate lock lever is not clear in appearance. That is, the switching position acts as a boundary to any one of the lock position and the unlock position to which the gate lock lever is urged by the urging member. In some cases, the operator releases his or her hand from the gate lock lever without rotating the gate lock lever to the lock position or the unlock position in a state of gripping the gate lock lever. In this case, the gate lock lever is possibly rotationally displaced by the spring member to one position of the lock position and the unlock position against an intent of the operator.

An object of the present invention is to provide a construction machine which can make a switching position of a gate lock lever clearly defined to certainly carry out an operation for switching the gate lock lever between a lock position and an unlock position thereof.

An aspect of the present invention is provided with a construction machine comprising:

a console device which is disposed on an entrance side of an operator's seat and includes an operating lever; and a gate lock device disposed in the console device, wherein the gate lock device includes:

a gate lock lever which includes an operating part to be operated by an operator and rotates between a lock position for making an operation of the operating lever invalid and an unlock position for making the operation of the operating lever valid; and an urging member for urging the gate lock lever to be rotated by the operating part toward the lock position or the unlock position, characterized in that:

on a basis of a switching position, in which the operating part is below an upper surface of the console device, as a boundary, the gate lock lever is switched toward any one of the lock position and the unlock position to which the gate lock lever is urged by the urging member;

when the operating part is in a position higher than the switching position, the urging member urges the gate lock lever to the lock position; and when the operating part is in a position lower than the switching position, the urging member urges the gate lock lever to the unlock position.

According to the aspect of the present invention, the upper surface of the console device can be defined as a reference for determining the switching position of the gate lock lever. Therefore, the switching position of the gate lock lever can be clearly defined to certainly switch the gate lock lever to the lock position and the unlock position.

MODE FOR CARRYING OUT THE INVENTION

Figure 1:
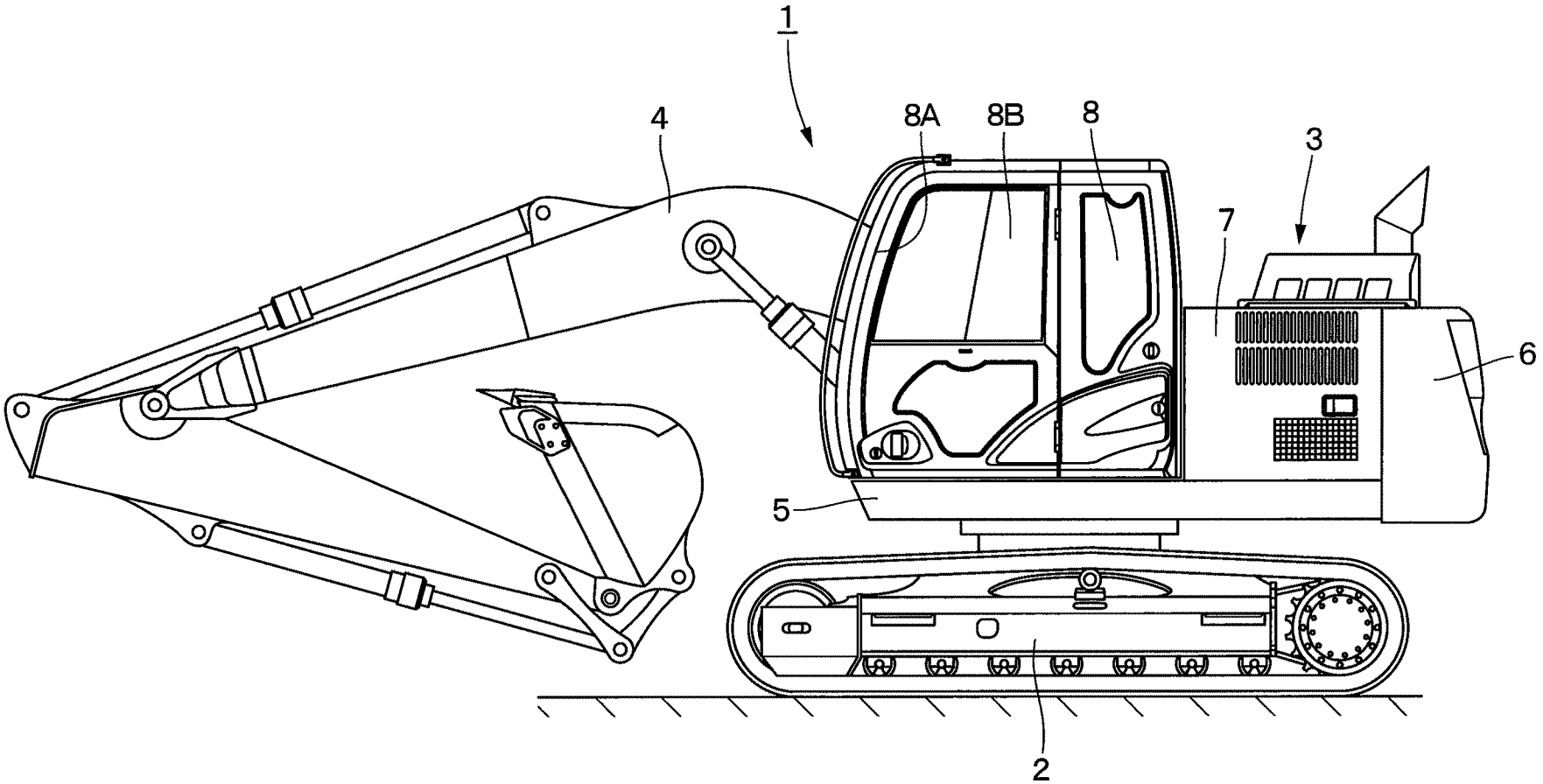
FIG. 1 is a left side view showing a hydraulic excavator according to an embodiment of the present invention.

Hereinafter, an embodiment of the present invention will be in detail explained referring to the accompanying drawings by taking a case of being applied to a hydraulic excavator as an example. It should be noted that an explanation will be made of the present embodiment by defining a traveling direction of the hydraulic excavator as a front-rear direction and a direction perpendicular to the traveling direction of the hydraulic excavator as a left-right direction.

In the figure, a hydraulic excavator 1 representative of a construction machine is provided with a lower traveling structure 2 of a crawler type capable of self-traveling in the front-rear direction and an upper revolving structure 3 mounted on the lower traveling structure 2 to be capable of revolving thereto. The lower traveling structure 2 and the upper revolving structure 3 configure a vehicle body of the hydraulic excavator 1. A working mechanism 4 is disposed on the front side of the upper revolving structure 3 to be capable of lifting and tilting thereto. The hydraulic excavator 1 travels in a working site by the lower traveling structure 2, and carries out an excavating work of earth and sand or the like by tilting and lifting the working mechanism 4 while revolving the upper revolving structure 3.

The upper revolving structure 3 is provided with a revolving frame 5 as a base. A counterweight 6 is disposed on the rear side of the revolving frame 5 to act as a balance weight to the working mechanism 4. The revolving frame 5 is provided with mount equipment devices of an engine, a hydraulic pump, a heat exchanger and the like (none of them is shown) mounted thereon to be positioned on the front side of the counterweight 6. These mount equipment devices are covered with an exterior cover 7 disposed on the revolving frame 5. A cab 8 defining an operator's room therein is disposed on a front left side of the upper revolving structure 3.

Figure 2:
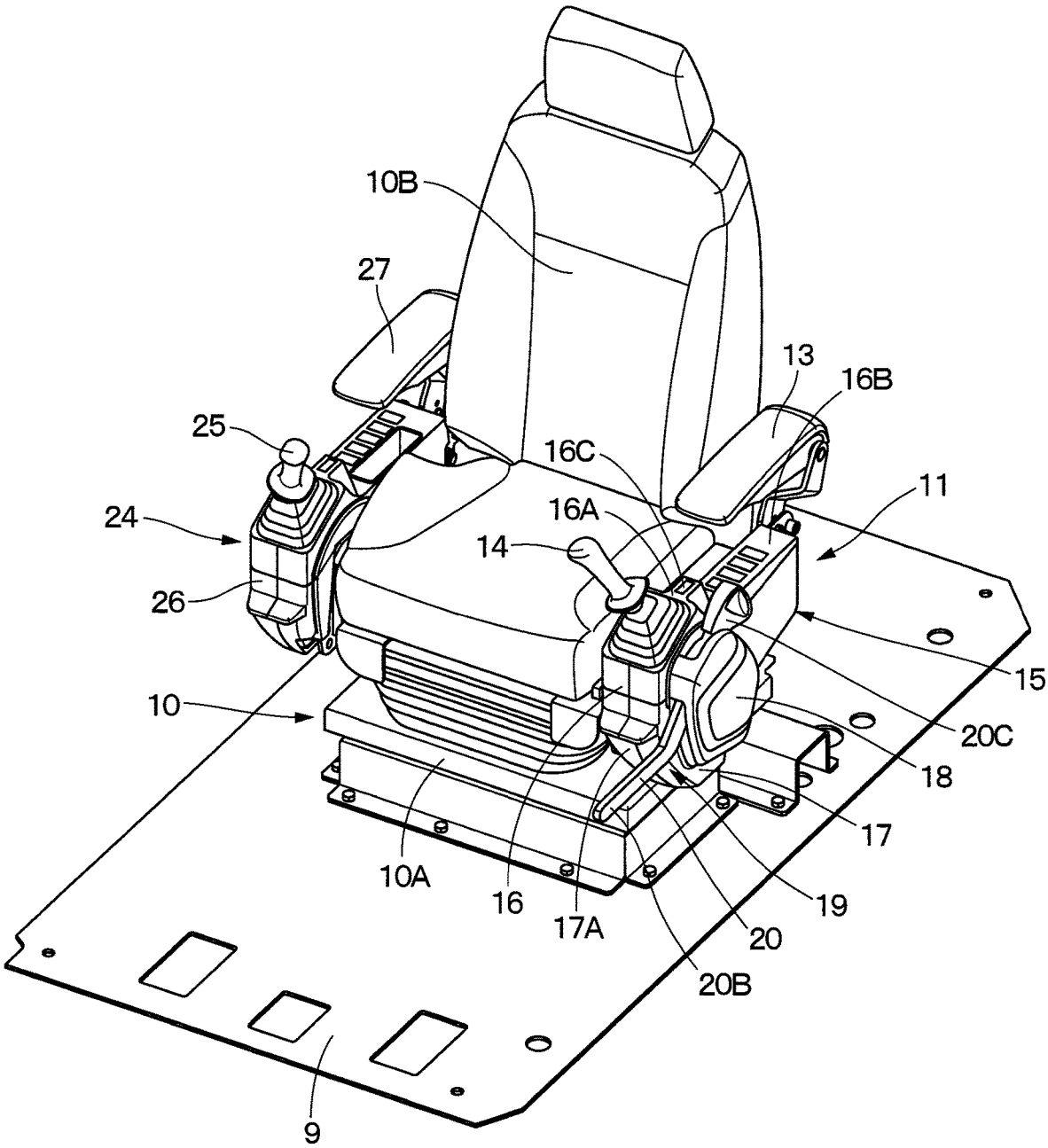
FIG. 2 is a perspective view showing a floor member, an operator's seat, left and right console devices, and a gate lock device.

The cab 8 is formed in a boxy shape to rise upward from the revolving frame 5 and the operator' room is defined in the cab 8. An entrance 8A for the operator to get in and out of the cab 8 and a door 8B for opening/closing the entrance 8A are arranged on a left side surface of the cab 8. A bottom side of the cab 8 is covered with a floor member 9. As shown in FIG. 2, the floor member 9 of the cab 8 is formed as a rectangular plate body long in the front-rear direction. In addition, an operator's seat 10, a left console device 11, a gate lock device 19 and a right console device 24, which will be described later, and the like are arranged in the operator's room in the cab 8.

The operator's seat 10 is disposed in the cab 8. As shown in FIG. 2, the operator's seat 10 is configured of an operator's seat base 10A attached on the floor member 9 and a seat 10B which is attached on the operator's seat base 10A and on which the operator sits. The operator's seat base 10A has a function of carrying out a positional adjustment of the seat 10B in accordance with a physical size of the operator in an upper-lower direction and in the front-rear direction.

Figure 3:
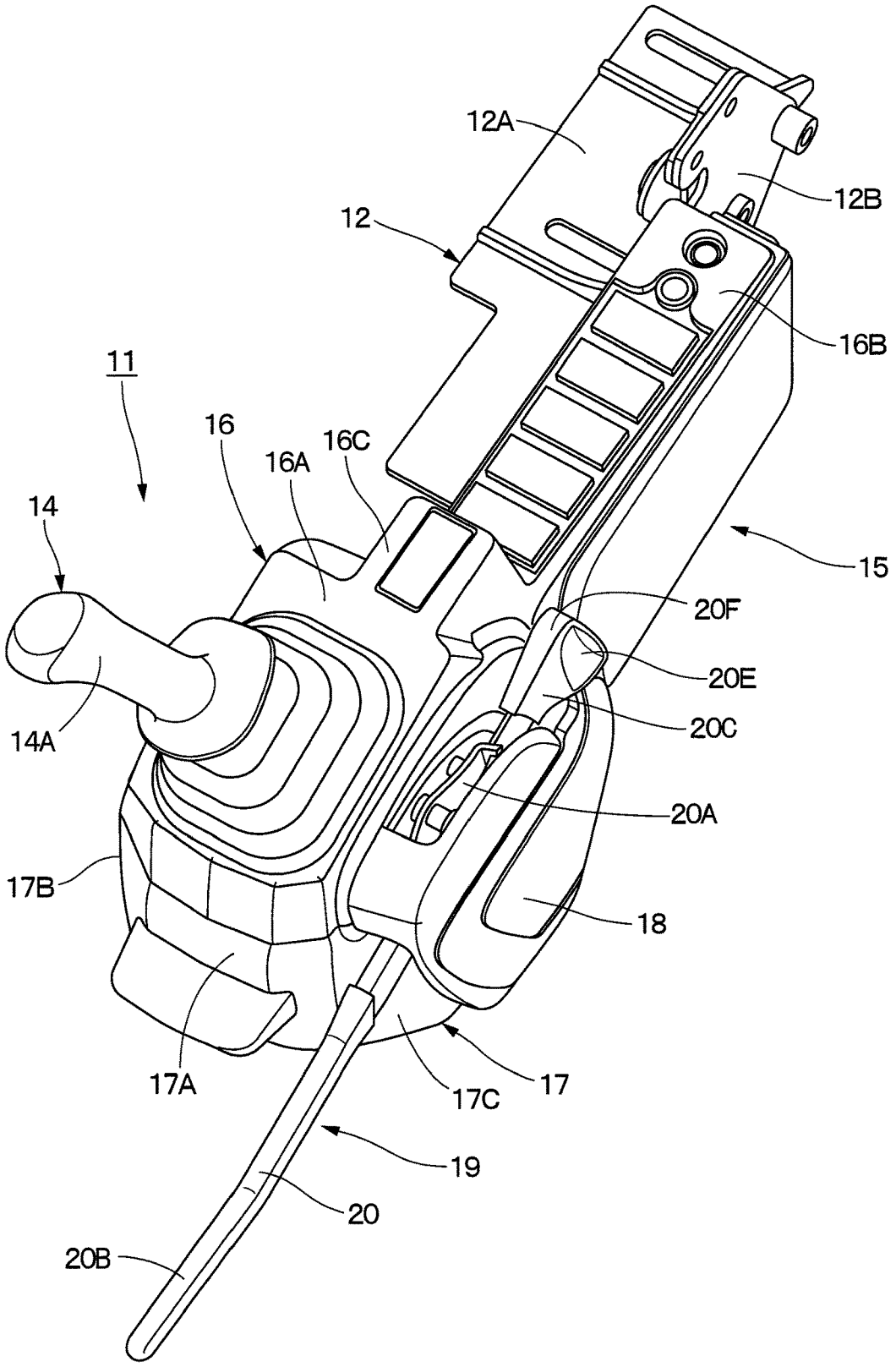
FIG. 3 is a perspective view showing the left console device and the gate lock device as viewed from a left, oblique, and upper side.

The left console device 11 is disposed on the entrance 8A-side in the cab 8, that is, on the left side of the operator's seat 10. As shown in FIG. 2 and FIG. 3, the left console device 11 includes a left console frame 12, a left operating lever 14, a left console cover 15, and the gate lock device 19.

The left console frame 12 is attached on the left side of the operator's seat base 10A. The left console frame 12 is provided with a base attaching part 12A attached on the operator's seat base 10A of the operator's seat 10 and a main frame part 12B extending forward from the base attaching part 12A. A left armrest 13 is attached on a rear end side of the main frame part 12B and is designed for a left elbow of the operator who sits in the operator's seat 10 to be placed thereon. The left operating lever 14 and the gate lock device 19 are arranged on a front end side of the main frame part 12B. Further, a fixing pin 12C is disposed on an intermediate part of the main frame part 12B in the front-rear direction to project to a left lateral side from the main frame part 12B. The fixing pin 12C configures another-end side attaching part for attaching other end 22B of a spring member 22 which will be described later.

The left operating lever 14 is disposed on a front-end upper side of the main frame part 12B configuring the left console frame 12. The left operating lever 14, together with a right operating lever 25 which will be described later, are operated by the operator to control the revolving movement of the upper revolving structure 3 and the movement of the working mechanism 4. The left operating lever 14 includes a pilot valve of a pressure reduction-valve type (not shown) attached on the front end of the main frame part 12B, and a lever part 14A which extends upward from the pilot valve and is tilted in the front-rear direction and in the left-right direction by the operator.

The left console cover 15 is attached on the left console frame 12 and forms an outer shell of the left console device 11. The left console cover 15 covers the left console frame 12 configuring the left console device 11, the pilot valve (not shown) of the left operating lever 14, the gate lock device 19 and the like. The left console cover 15 is formed using a resin material having elasticity and includes an upper cover 16, a lateral cover 17, and a gate lock cover 18.

The upper cover 16 covers the left console frame 12 and the like from above. The upper cover 16 is disposed on the front side of the left console frame 12 (main frame part 12B), and is configured of a front cover part 16A and a rear cover part 16B. The front cover part 16A covers the pilot valve of the left operating lever 14 and the like from above. The rear cover part 16B rises downward from the rear end of the front cover part 16A and extends to the rear side. The upper cover 16 is attached on the main frame part 12B by using bolts (not shown) or the like. An upper surface 16C of the front cover part 16A configuring the upper cover 16 is disposed in a position higher than an upper surface of the rear cover part 16B (on the upper side in the upper-lower direction), and forms an upper surface of the left console device 11.

The lateral cover 17 is positioned on the lower side of the upper cover 16, and covers the left console frame 12 and the like in the front-rear direction and in the left-right direction. The lateral cover 17 includes a front cover part 17A disposed on the front side of the left console frame 12, and an inner cover part 17B and an outer cover part 17C extending to the rear side from the front cover part 17A. The front cover part 17A covers the left console frame 12, the pilot valve of the left operating lever 14 and the like from the front side. The inner cover part 17B covers the left console frame 12, the pilot valve of the left operating lever 14 and the like from a right lateral side (the operator's seat 10-side). The outer cover part 17C covers a front portion of the left console frame 12 from a left lateral side.

The gate lock cover 18 is attached on a left side surface of the lateral cover 17 (outer cover part 17C). The gate lock cover 18 covers a rotation center part 20A of the gate lock lever 20 which will be described later, the spring member 22 and the like from a left lateral side. It should be noted that FIG. 4, FIG. 5, FIG. 6, and FIG. 7 show a state where the gate lock cover 18 is removed.

Next, an explanation will be made of the gate lock device 19 according to the present embodiment.

Figure 4:
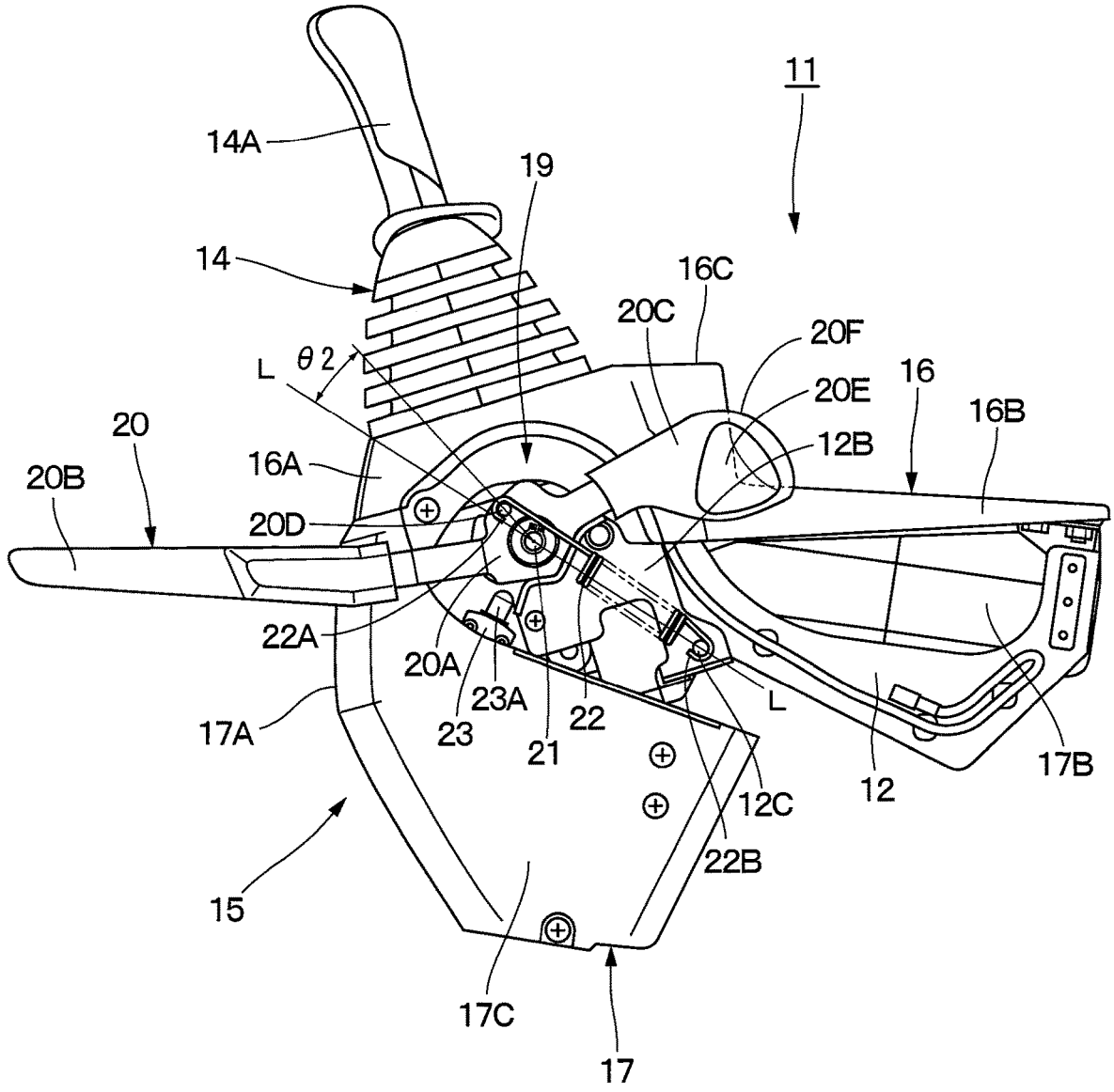
FIG. 4 is a left side view showing the left console device and the gate lock device in a state where the gate lock lever is retained in an unlock position.
Figure 5:
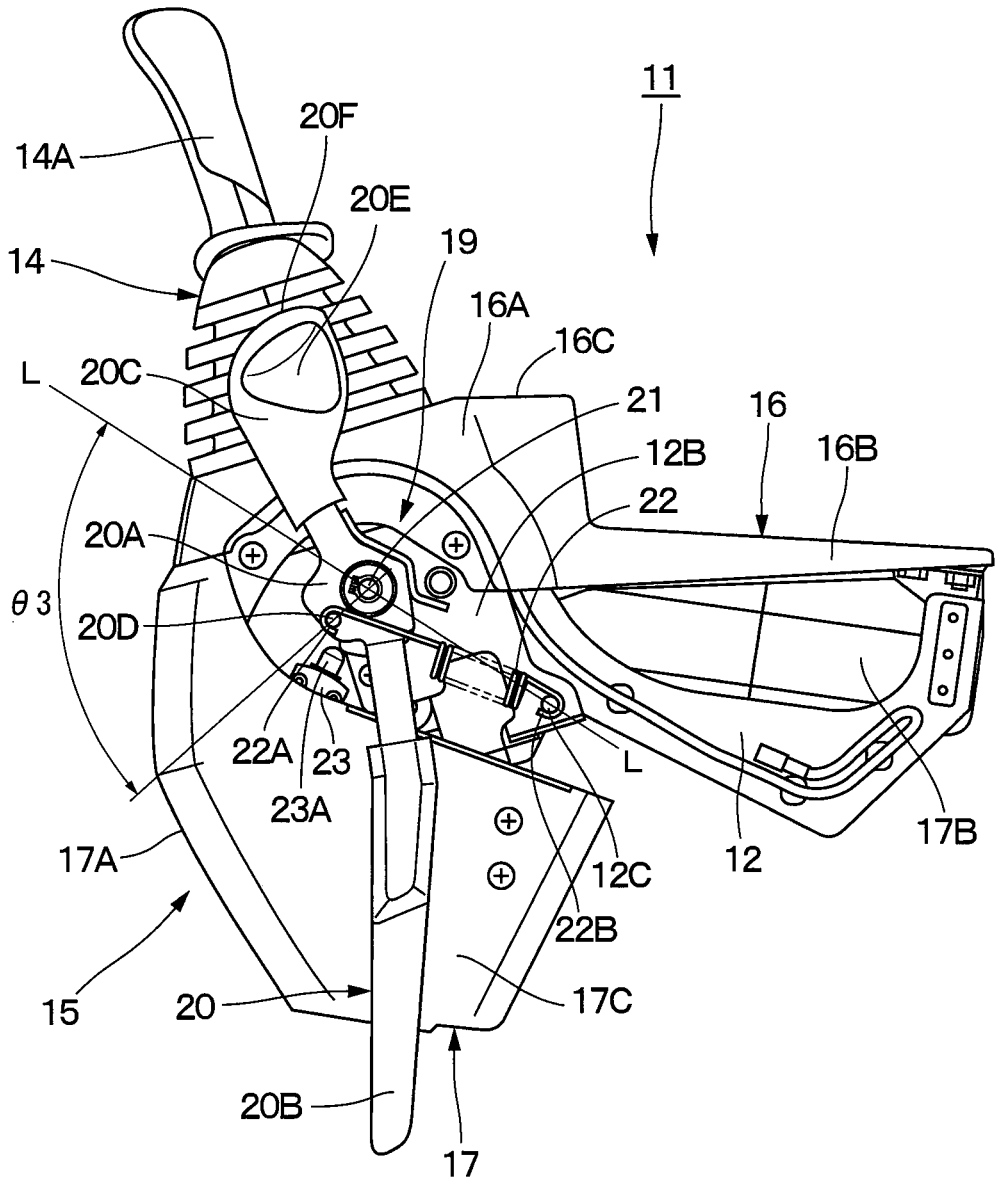
FIG. 5 is a left side view showing the left console device and the gate lock device in a state where the gate lock lever is retained in a lock position.

The gate lock device 19 is disposed in the left console device 11, which is on the entrance side of the operator's seat 10, of the left console device 11 and the right console device 24. The gate lock device 19 rotationally displaces between the unlock position as shown in FIG. 4 and the lock position as shown in FIG. 5. The gate lock device 19 prohibits the operator from getting in and out of the cab 8 at the time of being in the unlock position, and permits the operator from getting in and out of the cab 8 at the time of being in the lock position. The gate lock device 19 includes the gate lock lever 20, the spring member 22, a gate lock switch 23 and the like.

The gate lock lever 20 is attached on the front portion of the main frame part 12B configuring the left console frame 12 to be rotatable in the front-rear direction and in the upper-lower direction. The gate lock lever 20 is formed by a plate body extending in the front-rear direction in a state of being in the unlock position as shown in FIG. 4. The gate lock lever 20 includes the rotation center part 20A which is wide in width and is positioned in the intermediate part in the longitudinal direction, a gate lever part 20B which is narrow in width and extends forward from the rotation center part 20A in a state of being in the unlock position, and an operating part 20C extending backward from the rotation center part 20A in a state of being in the unlock position.

The rotation center part 20A of the gate lock lever 20 is attached on the main frame part 12B of the left console frame 12 via a support shaft 21 as a rotation fulcrum. The gate lock lever 20 rotationally displaces around the support shaft 21 as the rotation fulcrum in response to the operation of the operating part 20C by the operator. The gate lock lever 20 rotationally displaces between the unlock position (position in FIG. 4) in which the gate lever part 20B projects forward from the left console device 11 and the lock position (position in FIG. 5) in which the gate lever part 20B extends downward.

When the gate lock lever 20 is in the unlock position (position in FIG. 4), the gate lever part 20B prohibits the operator from getting in and out of the cab 8 and the operations of the left operating lever 14 and the right operating lever 25 are made valid. Accordingly, when the gate lock lever 20 is in the unlock position, the revolving movement of the upper revolving structure 3 and the movement of the working mechanism 4 are operated in response to the operations of the left and right operating levers 14, 25. On the other hand, when the gate lock lever 20 is in the lock position (position in FIG. 5), the operator is permitted to get in and out of the cab 8 and the operations of the left operating lever 14 and the right operating lever 25 are made invalid. Accordingly, when the gate lock lever 20 is in the lock position, the revolving movement of the upper revolving structure 3 and the movement of the working mechanism 4 are prohibited regardless of the operations of the left and right operating levers 14, 25.

The rotation center part 20A of the gate lock lever 20 is provided with a movable pin 20D in a portion thereof separated from the support shaft 21. The movable pin 20D is disposed to project on the left lateral surface of the rotation center part 20A using means of welding or the like and rotates around the support shaft 21 together with the gate lock lever 20. The movable pin 20D configures a one-end side attaching part on which one end 22A of the spring member 22 which will be described later is attached.

The operating part 20C of the gate lock lever 20 is disposed at the opposite to the gate lever part 20B across the rotation center part 20A. The operating part 20C is operated by the operator to rotationally displace the gate lock lever 20 from the lock position to the unlock position or from the unlock position to the lock position. Here, a concave recess part 20E formed by recessing a left lateral surface of the operating part 20C in the operator's seat 10-side is disposed on the rear end of the operating part 20C in a state where the gate lock lever 20 is in the unlock position. The concave recess part 20E is configured such that the operator can certainly operate the operating part 20C by laying his or her hand on the concave recess part 20E.

The spring member 22 as an urging member is disposed between the main frame part 12B of the left console frame 12 and the rotation center part 20A of the gate lock lever 20. The spring member 22 is formed using a tension coil spring, for example. The one end 22A of the spring member 22 is attached on the movable pin 20D as the one-end side attaching part disposed to project on the rotation center part 20A. The other end 22B of the spring member 22 is attached on the fixing pin 12C as the other-end side attaching part disposed to project on the main frame part 12B of the left console frame 12. Accordingly, the tension force (spring force) of the spring member 22 acts all the time on the movable pin 20D disposed to project on the gate lock lever 20 (rotation center part 20A). Thereby, the gate lock lever 20 is all the time urged to the unlock position (position in FIG. 4) or the lock position (position in FIG. 5) by the tension force of the spring member 22. On a basis of a position (switching position), where the operating part 20C of the gate lock lever 20 is below the upper surface 16C of the upper cover 16 configuring the left console device 11, as a boundary, the gate lock lever 20 is switched toward any one of the lock position and the unlock position to which the gate lock lever 20 is urged by the spring member 22. It should be noted that a stopper (not shown) is disposed on the gate lock device 19 to prohibit the gate lock lever 20 from being rotationally displaced over the unlock position or the lock position.

Figure 6:
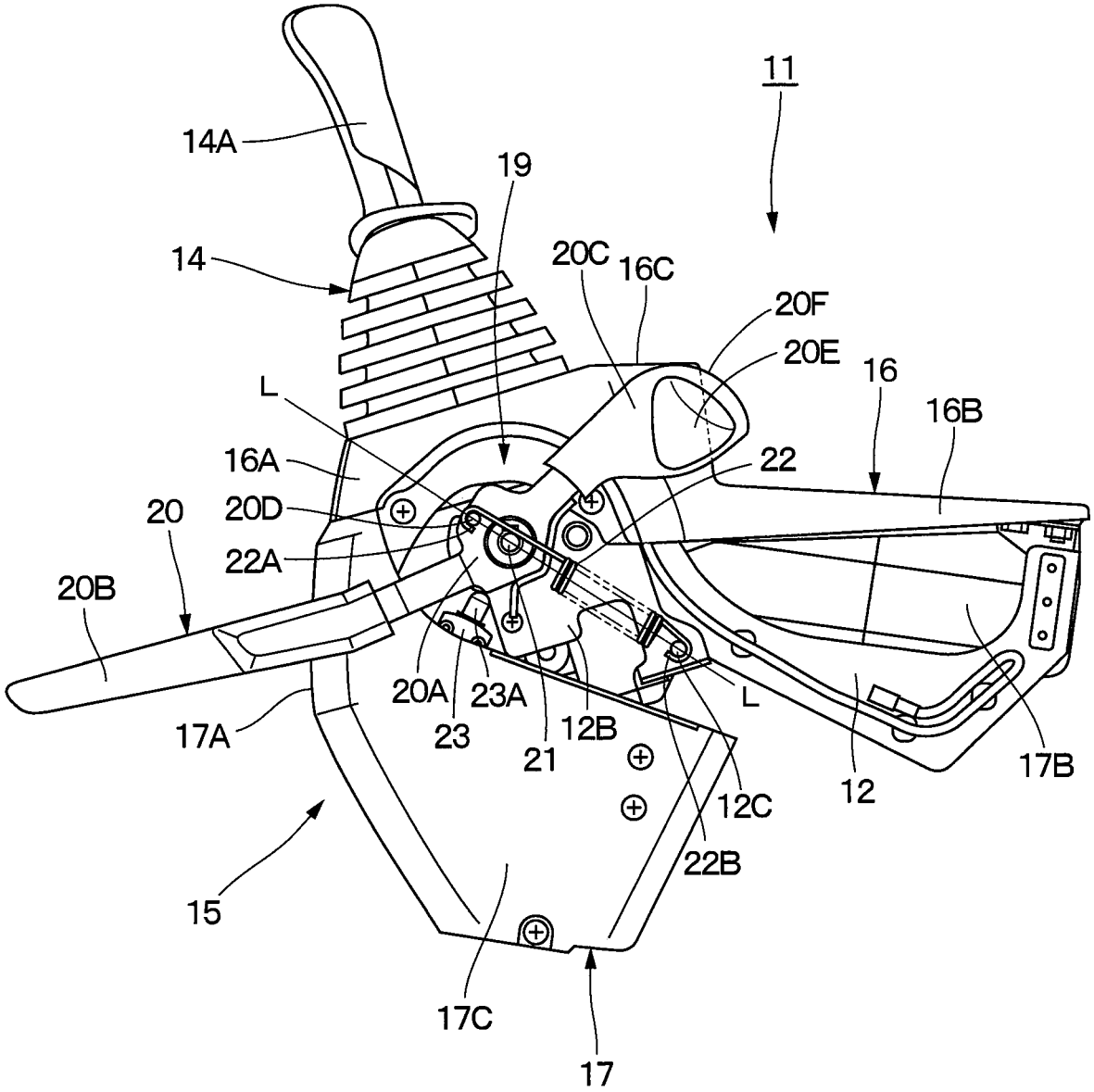
FIG. 6 is a left side view showing the left console device and the gate lock device in a state where the gate lock lever is in a switching position.

Here, a center of the support shaft 21 as the rotation fulcrum of the gate lock lever 20, a center of the movable pin 20D on which the one end 22A of the spring member 22 is attached and a center of the fixing pin 12C on which the other end 22B of the spring member 22 is attached will be focused attention on. FIG. 6 shows a state where the center of the movable pin 20D (one-end side attaching part) is disposed on a straight line L-L to connect between the center of the fixing pin 12C (other-end side attaching part) and the center of the support shaft 21. At this time, a height position of the uppermost part on an outer peripheral surface 20F of the operating part 20C corresponds to a height position of the upper surface 16C of the upper cover 16 configuring the left console device 11 (left console cover 15).

In the present embodiment, a position of the gate lock lever 20 as shown in FIG. 6 is set as the switching position of the gate lock lever 20. In the switching position of the gate lock lever 20, the height position of the uppermost part on the outer peripheral surface 20F of the operating part 20C corresponds to the height position of the upper surface 16C of the upper cover 16. That is, the position where the operating part 20C of the gate lock lever 20 is below the height position of the upper surface 16C of the upper cover 16 in the left console device 11 is set as the switching position of the gate lock lever 20. When the gate lock lever 20 is in the switching position as shown in FIG. 6, the tension force of the spring member 22 reaches the maximum value. In the switching position, the centers of the movable pin 20D, the fixing pin 12C and the support shaft 21 line up on the straight line L-L. Therefore, it is possible to restrict the rotational displacement of the gate lock lever 20 around the support shaft 21 as the rotation fulcrum.

Figure 7:
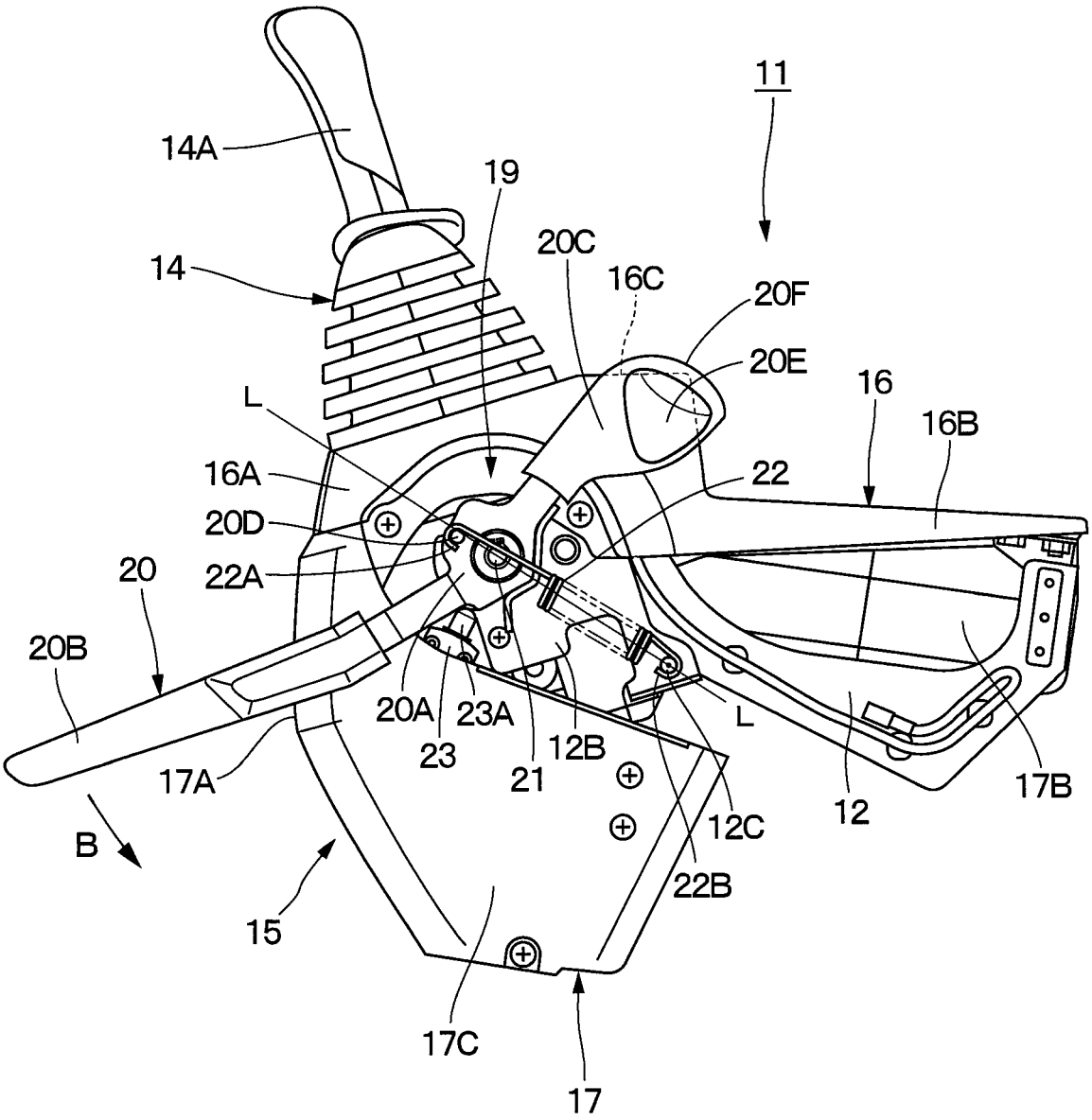
FIG. 7 is a left side view showing the left console device and the gate lock device in a state where an operating part of the gate lock lever projects slightly over an upper surface of the left console device.

Accordingly, for example as shown in FIG. 7, in a case where the outer peripheral surface 20F of the operating part 20C of the gate lock lever 20 is in a height position slightly higher than the upper surface 16C of the upper cover 16, the center of the movable pin 20D is positioned to be lower than the straight line L-L. In this case, the spring member 22 urges the gate lock lever 20 in the counterclockwise direction (arrow B direction) toward the lock position. On the other direction, in a case where the outer peripheral surface 20F of the operating part 20C of the gate lock lever 20 is in the height position lower than the upper surface 16C of the upper cover 16, the center of the movable pin 20D is positioned in the upper side over the straight line L-L. In this case, the spring member 22 urges the gate lock lever 20 in the clockwise direction toward the unlock position.

Figure 8:
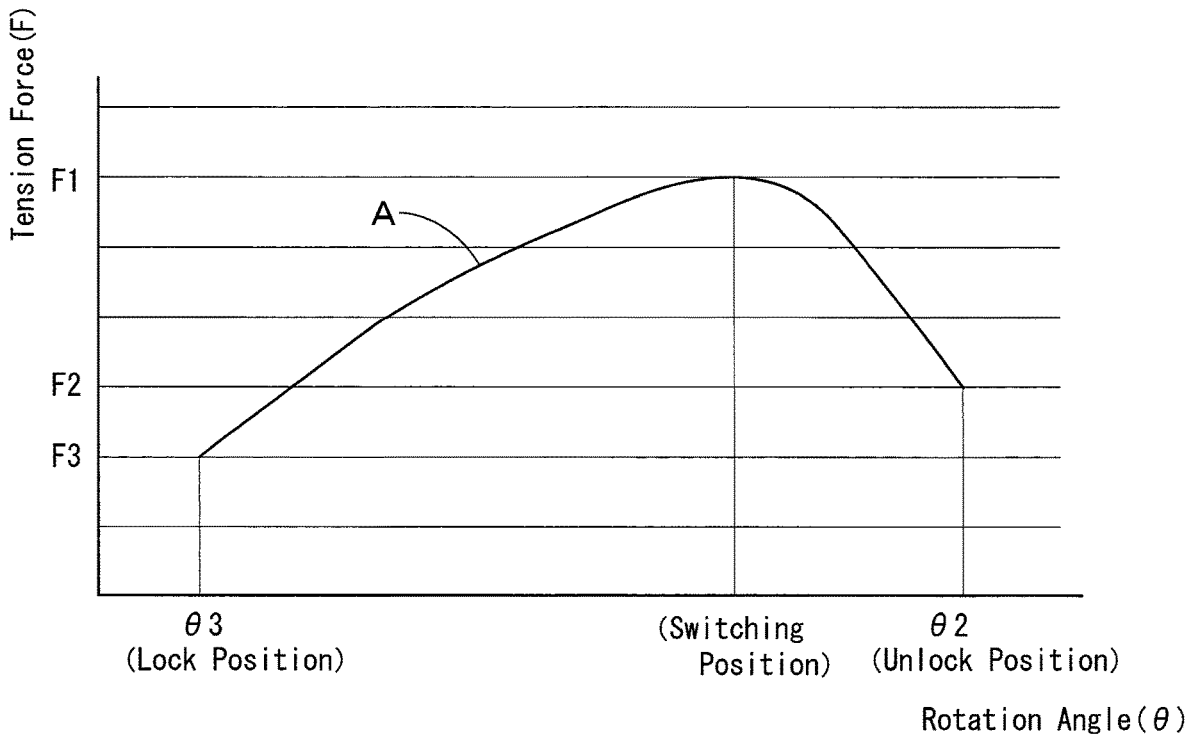
FIG. 8 is a characteristic diagram showing a relationship between a rotation angle of the gate lock lever and a tension force of a spring member.

In this case, as shown by a characteristic line A in FIG. 8, when the gate lock lever 20 is in the switching position (position in FIG. 6), the tension force of the spring member 22 reaches the maximum value F1. When the gate lock lever 20 is displaced by a rotation angle θ2 from the switching position to the unlock position (position in FIG. 4), the tension force of the spring member 22 becomes F2 smaller than F1 (F1>F2). When the gate lock lever 20 is displaced by a rotation angle θ3 from the switching position to the lock position (position in FIG. 5), the tension force of the spring member 22 becomes F3 smaller than F2 (F2>F3). That is, the tension force (urging force) F2 at the time the spring member 22 retains the gate lock lever 20 in the unlock position is set to be larger than the tension force F3 at the time the spring member 22 retains the gate lock lever 20 in the lock position.

In this way, in the present embodiment when the gate lock lever 20 is positioned between the lock position and the unlock position as shown in FIG. 6, a position where the height position of the uppermost part on the outer peripheral surface 20F of the operating part 20C configuring the gate lock lever 20 corresponds to the height position of the upper surface 16C of the upper cover 16 configuring the left console device 11 (left console cover 15), that is, a position where the operating part 20C of the gate lock lever 20 is below the upper surface 16C of the upper cover 16 in the left console device 11 is set as the switching position of the gate lock lever 20. Accordingly, the operator can clearly recognize the switching position of the gate lock lever 20 in appearance on a basis of the upper surface 16C of the upper cover 16. Therefore, the operator can rotationally displace the gate lock lever 20 to the lock position by displacing the outer peripheral surface 20F of the operating part 20C upward over the upper surface 16C of the upper cover 16. In addition, the operator can rotationally displace the gate lock lever 20 to the unlock position by displacing the outer peripheral surface 20F of the operating part 20C closer to the downward than the upper surface 16C of the upper cover 16. Thereby, the operator can certainly carry out the switching operation of the gate lock lever 20.

A gate lock switch 23 is positioned near the rotation center part 20A of the gate lock lever 20 to be attached on the main frame part 12B of the left console frame 12. The gate lock switch 23 is provided with a detection part 23A which is pressed by the rotation center part 20A when the gate lock lever 20 is rotationally displaced to the lock position.

In addition, when the gate lock lever 20 is rotationally displaced to the lock position, the detection part 23A of the gate lock switch 23 is pressed by the rotation center part 20A. Thereby, it is detected that the gate lock lever 20 is in the lock position, which makes the operations of the left operating lever 14 and the right operating lever 25 invalid. Thereby, the revolving movement of the upper revolving structure 3 and the movement of the working mechanism 4 are prohibited regardless of the operations of the left and right operating levers 14, 25. On the other hand, when the gate lock lever 20 is rotationally displaced to the unlock position, the detection part 23A is separated from the rotation center part 20A. Thereby, it is detected that the gate lock lever 20 is in the unlock position, which makes the operations of the left operating lever 14 and the right operating lever 25 valid. Thereby, the revolving movement of the upper revolving structure 3 and the movement of the working mechanism 4 are controlled in response to the operations of the left and right operating levers 14, 25.

The right console device 24 is disposed at the opposite to the left console device 11 in the left-right direction, that is, on the right side to the operator's seat 10 (refer to FIG. 2). The right console device 24 is configured in similar to the left console device 11 except as to a point where the gate lock device 19 is not disposed. That is, the right console device 24 includes a right console frame (not shown), a right operating lever 25, a right console cover 26 and the like, and a right armrest 27 is attached on a rear end side of the right console frame. The detailed configurations of the above components are omitted in explanation because of being in similar to those in the left console device 11.

The hydraulic excavator 1 according to the present embodiment has the configuration as described above, and hereinafter, an explanation will be made of an operation thereof.

An operator opens the door 8B of the cab 8, goes through the entrance 8A and gets in cab 8, and then, goes in front of the left console device 11 and sits on the seat 10B. Since at this time, the gate lock lever 20 of the gate lock device 19 is retained in the lock position (position in FIG. 5), the operator starts with an engine (not shown) and after that, operates the operating part 20C of the gate lock lever 20 for rotation in the clockwise direction and rotationally displaces the gate lock lever 20 to the unlock position (position in FIG. 4). Thereby, the operations of the left operating lever 14 and the right operating lever 25 are made valid. Accordingly, the operator operates the left and right operating levers 14, 25 and the like in a working site, thus making it possible to carry out the excavating work and the like using the working mechanism 4 while revolving the upper revolving structure 3.

Here, in the present embodiment the position where the height position of the uppermost part of the outer peripheral surface 20F in the operating part 20C configuring the gate lock lever 20 corresponds to the height position of the upper surface 16C of the upper cover 16 configuring the left console device 11 (left console cover 15) is set as the switching position of the gate lock lever 20. That is, when the operating part 20C of the gate lock lever 20 is below the upper surface 16C of the left console device 11 (the upper cover 16), the gate lock lever 20 is switched toward any one of the lock position and the unlock position to which the gate lock lever 20 is urged by the spring member 22. Accordingly, the operator can clearly recognize the switching position of the gate lock lever 20 in appearance on a basis of the upper surface 16C of the upper cover 16. Therefore, the operator can rotationally displace the gate lock lever 20 from the lock position to the unlock position by displacing the outer peripheral surface 20F of the operating part 20C in the gate lock lever 20 closer to the downward than the upper surface 16C of the upper cover 16.

In addition, in the present embodiment, the tension force F2 of the spring member 22 at the time the spring member 22 retains the gate lock lever 20 in the unlock position is set to be larger than the tension force F3 of the spring member 22 at the time the spring member 22 retains the gate lock lever 20 in the lock position. Therefore, it is possible to suppress vibrations at the operating of the hydraulic excavator 1 from being transmitted to the gate lock lever 20, enhancing durability of the gate lock device 19.

In addition, after finishing the excavating work and the like using the hydraulic excavator 1, the operator can rotationally displace the gate lock lever 20 from the unlock position to the lock position. Thereby, since the operations of the left and right operating levers 14, 25 and the like are made invalid, it is possible to prevent an erroneous operation due to an erroneous contact of the operator with the left and right operating levers 14, 25 and the like at the next excavating work.

Here, in a case of rotationally displacing the gate lock lever 20 from the unlock position to the lock position, the operating part 20C of the gate lock lever 20 retained in the unlock position is in a position lower than the upper surface 16C of the upper cover 16. Therefore, in some cases, the operator siting on the operator's seat 10 is difficult to visually contact the operating part 20C. On the other hand, in the present embodiment the concave recess part 20E is disposed on the operating part 20C of the gate lock lever 20. Therefore, the operator can easily recognize the operating part 20C by contacting the concave recess part 20E by his or her hand. The operator can certainly carry out the operation of rotationally displacing the gate lock lever 20 from the unlock position to the lock position.

In addition, for example, even in a case where the operator loses a balance at the time of rotationally displacing the gate lock lever 20 from the unlock position to the lock position, the operator lays his or her hand on the upper surface 16C of the upper cover 16, thereby making it possible to suppress the outer peripheral surface 20F of the operating part 20C from being pressed down to the position lower than the upper surface 16C of the upper cover 16 in error. As a result, it is possible to prevent the gate lock lever 20 from being switched from the lock position to the unlock position against the operator's intent.

In this way, in the hydraulic excavator 1 according to the present embodiment, the gate lock device 19 is disposed on the left console device 11 in the entrance 8A-side of the cab 8, and the gate lock device 19 includes the gate lock lever 20 which has the operating part 20C to be operated by the operator and is rotated between the lock position and the unlock position, and the spring member 22 urging the gate lock lever 20 to be rotated by the operating part 20C toward the lock position or the unlock position. On a basis of the switching position, in which the operating part 20C of the gate lock lever 20 is below the upper surface 16C of the left console device 11 (the upper cover 16), as the boundary, the gate lock lever 20 is switched toward any one of the lock position and the unlock position to which the gate lock lever 20 is urged by the spring member 22. When the operating part 20C is in the position higher than the switching position, the spring member 22 urges the gate lock lever 20 to the lock position, and when the operating part 20C is in the position lower than the switching position, the spring member 22 urges the gate lock lever 20 to the unlock position.

According to this configuration, the operator can clearly recognize the switching position of the gate lock lever 20 in appearance on a basis of the upper surface 16C of the upper cover 16. Accordingly, the operator can certainly carry out the operation of switching the gate lock lever 20 between the lock position and the unlock position.

In the present embodiment, the switching position is set to the height position of the upper surface 16C of the upper cover 16. When the operating part 20C of the gate lock lever 20 is in the high position lower than the upper surface 16C of the left console device 11 (upper cover 16), the spring member 22 urges the gate lock lever 20 to the unlock position. When the operating part 20C of the gate lock lever 20 is in the height position higher than the upper surface 16C of the left console device 11, the spring member 22 urges the gate lock lever 20 to the lock position.

According to this configuration, the gate lock lever 20 can certainly be rotationally displaced to the unlock position by displacing the operating part 20C of the gate lock lever 20 closer to the downward than the upper surface 16C of the upper cover 16. On the other hand, the gate lock lever 20 can certainly be rotationally displaced to the lock position by displacing the operating part 20C of the gate lock lever 20 closer to the upward than the upper surface 16C of the upper cover 16.

In the present embodiment, the spring member 22 has the one end 22A attached on the gate lock lever 20 and the other end 22B attached on the left console frame 12 (a member other than the gate lock lever 20 of the gate lock device 19). When the height position of the operating part 20C in the gate lock lever 20 corresponds to the height position of the upper surface 16C in the left console device 11, the movable pin 20D (one-end side attaching part) on which the one end 22A of the spring member 22 is attached is disposed on the straight line L-L to connect between the fixing pin 12C (other-end side attaching part) on which the other end 22B of the spring member 22 is attached and the support shaft 21 (rotation fulcrum) of the gate lock lever 20. According to this configuration, in the switching position of the gate lock lever 20 where the height position of the operating part 20C in the gate lock lever 20 corresponds to the height position of the upper surface 16C in the left console device 11, the centers of the movable pin 20D, the fixing pin 12C and the support shaft 21 line up on the straight line L-L. Therefore, it is possible to restrict the rotational displacement of the gate lock lever 20 around the support shaft 21 as the rotation fulcrum.

In the present embodiment, the tension force (urging force) F2 at the time the spring member 22 retains the gate lock lever 20 in the unlock position is set to be larger than the tension force (urging force) F3 at the time the spring member 22 retains the gate lock lever 20 in the lock position. According to this configuration, in a state where the gate lock lever 20 is retained in the unlock position, it is possible to suppress vibrations at the operating of the hydraulic excavator 1 from being transmitted to the gate lock lever 20, enhancing the durability of the gate lock device 19.

In the present embodiment the concave recess part 20E for the operator to contact by his or her hand is disposed on the operating part 20C of the gate lock lever 20. According to this configuration, for example, in a case of rotationally displacing the gate lock lever 20 from the unlock position to the lock position, the operator can easily recognize the operating part 20C by contacting the concave recess part 20E by his or her hand to certainly carry out the switching operation of the gate lock lever 20.

It should be noted that the embodiment shows as an example a case where the position where the uppermost part of the outer peripheral surface 20F in the operating part 20C disposed in gate lock lever 20 corresponds to the height position of the upper surface 16C in the upper cover 16 configuring the left console device 11 is set as the switching position of the gate lock lever 20. The present invention, however, is not limited thereto, and a position where the uppermost part of the outer peripheral surface 20F in the operating part 20C is lower than the upper surface 16C in the upper cover 16 may be set as the switching position of the gate lock lever 20.

In addition, the embodiment shows an example in which the cab 8 is disposed on the front left side of the upper revolving structure 3 and the gate lock device 19 is disposed on the left console device 11 positioned in the entrance 8A-side of the cab 8. However, the present invention is not limited thereto, and may be configured, for example such that a cab is disposed on a front right side of the upper revolving structure 3 and a gate lock device is disposed on a right console device positioned in an entrance side of this cab.

In addition, the embodiment shows as an example the hydraulic excavator 1 in which the cab 8 is disposed on the front left side of the upper revolving structure 3. However, the present invention is not limited thereto, and may be applied also to a hydraulic excavator provided with a canopy for covering an operator's seat from above instead of a cab, for example.

Further, the embodiment is explained by taking the hydraulic excavator 1 as an example of a construction machine. However, the present invention is not limited thereto, and may be widely applied also to other construction machines of hydraulic cranes and wheel loaders, for example.

DESCRIPTION OF REFERENCE NUMERALS

1: HYDRAULIC EXCAVATOR (CONSTRUCTION MACHINE)
8: CAB
8A: ENTRANCE
11: LEFT CONSOLE DEVICE
12: LEFT CONSOLE FRAME
12C: FIXING PIN (OTHER-END SIDE ATTACHING PART)
14: LEFT OPERATING LEVER
16: UPPER COVER
16C: UPPER SURFACE
19: GATE LOCK DEVICE
20: GATE LOCK LEVER
20C: OPERATING PART
20D: MOVABLE PIN (ONE-END SIDE ATTACHING PART)
21: SUPPORT SHAFT (ROTATION FULCRUM)
22: SPRING MEMBER (URGING MEMBER)
22A: ONE END
22B: OTHER END
24: RIGHT CONSOLE DEVICE
25: RIGHT OPERATING LEVER

The invention claimed is:

1. A construction machine comprising:

a console device which is disposed to fixed to an operator's seat on an entrance side of the operator's seat and includes an operating lever; and a gate lock device disposed in the console device, wherein the gate lock device includes:

a gate lock lever operated by an operator and rotates between a lock position for making an operation of the operating lever invalid and an unlock position for making the operation of the operating lever valid; and an urging member for urging the gate lock lever toward the lock position or the unlock position, a support shaft provided with the console device that allows the gate lock lever to be rotatable in the front-rear direction and in the upper-lower direction, the gate lock lever includes a gate lever part which extend forward from the support shaft as the rotation center and projects from the console device in a state of being in the unlock position, and an operating part extends backward from the support shaft as the rotation center in a state of being in the unlock position and is operated by the operator, wherein:

on a basis of a switching position, in which a height position of the uppermost part on an outer peripheral surface of the operating part corresponds to a height position of an upper surface of the console device, as a boundary, the gate lock lever is switched toward any one of the lock position and the unlock position to which the gate lock lever is urged by the urging member;

when the uppermost part on the outer peripheral surface of the operating part is in a height position lower than the upper surface of the console device, the urging member urges the gate lock lever to the unlock position;

when the uppermost part on the outer peripheral surface of the operating part is in a height position higher than the upper surface of the console device, the urging member urges the gate lock lever to the lock position; and a rotation angle of the gate lock lever at the time the gate lock lever displaces from the switching position to the unlock position is smaller than a rotation angle of the gate lock lever at the time the gate lock lever displaces from the switching position to the lock position; and an urging force of the urging member at the time the urging member retains the gate lock lever in the unlock position is set to be larger than an urging force of the urging member at the time the urging member retains the gate lock lever in the lock position.

2. The construction machine according to claim 1, wherein:

the urging member is formed by a spring member which has one end attached on the gate lock lever and the other end attached on a member other than the gate lock lever of the gate lock device; and when a height position of the uppermost part on an outer peripheral surface of the operating part corresponds to a height position of the upper surface of the console device, a one-end side attaching part on which the one end of the spring member is attached is configured to be disposed on a straight line to connect between another-end side attaching part on which the other end of the spring member is attached and a rotation fulcrum of the gate lock lever.

3. The construction machine according to claim 1, wherein the operating part is provided with a concave recess part for an operator to contact by his or her hand.

* * * * *